United States Patent [19]

Erickson et al.

[11] 4,318,662

[45] Mar. 9, 1982

[54] BACKHOE COUPLING DEVICE

[75] Inventors: Allen O. Erickson; Howard W. Thomas, both of Davenport, Iowa

[73] Assignee: J. I. Case Company, Racine, Wis.

[21] Appl. No.: 156,822

[22] Filed: Jun. 5, 1980

[51] Int. Cl.[3] ..... B66F 9/00

[52] U.S. Cl. ..... 414/686; 172/272

[58] Field of Search ..... 414/686, 694; 172/272, 172/273, 274; 280/456 R, 460 R, 461 R, 477; 180/11

[56] References Cited

U.S. PATENT DOCUMENTS

| | | | |
|---|---|---|---|
| 722,262 | 3/1903 | Stone | 180/11 |
| 3,195,651 | 7/1965 | Todd | 172/272 |
| 3,312,478 | 4/1967 | Knaapi | 172/272 |
| 3,732,996 | 5/1973 | Bauer | 414/686 |
| 3,844,425 | 10/1974 | Bailey | 414/686 |
| 4,043,470 | 8/1977 | Pitch | 280/477 |
| 4,242,034 | 12/1980 | Schmitz | 414/686 |

FOREIGN PATENT DOCUMENTS

| | | | |
|---|---|---|---|
| 509024 | 1/1955 | Canada | 172/272 |

*Primary Examiner*—Robert B. Reeves
*Assistant Examiner*—Brian Bond
*Attorney, Agent, or Firm*—Cullen, Sloman, Cantor, Grauer, Scott & Rutherford

[57] ABSTRACT

A coupling device is disclosed for attaching an implement such as a backhoe to a tractor or other prime mover. The coupling device includes a pair of implement support assemblies connected together by a transverse cross bar for mounting an implement support frame. Each implement support assembly includes a frame bracket or weldment having an attachment pin receiving recess or hook at its lower end for holding a transverse attachment pin which is secured to the lower implement support frame. Yoke assemblies are pivotally attached between the implement support frame and each implement support assembly for the purpose of tightly securing the implement attachment pins against the frame bracket recesses, thereby eliminating any tolerance movement at the attachment points between the implement and prime mover.

4 Claims, 5 Drawing Figures

BACKHOE COUPLING DEVICE

BACKGROUND OF THE INVENTION

The present invention relates to a coupling device for attaching an implement to a prime mover, and more particularly, to a device which eliminates play or movement at the mounting points between the implement and prime mover.

The prior art discloses a number of different coupling devices for attaching an implement such as a backhoe to a tractor or other prime mover. Several of these coupling devices are of the quick connect or disconnect type for readily coupling and uncoupling the implement to the prime mover. A problem encountered with these prior quick coupling constructions that they permit a certain amount of play or movement at the attachment points between the implement and prime mover which reduces the operating stability of the implement. Thus, there has been a need for a coupling device which elminates tolerance movement at the attachmemt points between the implement and prime mover.

The disadvantages of prior quick coupler constructions that allow movement at the attachment points between the implement and prime mover have resulted in the coupling device of the present invention. It is an object of the present invention to provide a coupling device between a tractor or other prime mover and implement which permits the implement to be readily coupled and uncoupled to the prime mover without the need for special tools, maneuvering, or the like. A further object of this invention is to provide a coupling device constructed to eliminate tolerance movement at the attachment points between the implement and prime mover.

SUMMARY OF THE INVENTION

The coupling device of the present invention is particularly adapted to attach an implement such as a backhoe to a tractor or other prime mover. In the disclosed embodiment, the coupling device includes a pair of implement support assemblies connected together by a transverse cross bar for mounting an implement support frame. Each implement support assembly includes a frame bracket or weldment having an attachment pin receiving recess or hook at its lower end for holding a transverse attachment pin which is secured to the lower implement support frame. A yoke assembly is attached between the implement support frame and implement support assembly for the purpose of tightly securing the backhoe attachment pin against the frame bracket recess thereby eliminating any tolerance movement at the attachment point between the implement and prime mover.

The implement support assembly is of the quick connect or disconnect type for readily coupling and uncoupling implements to the prime mover. As described, each implement supporting assembly includes a frame bracket or weldment having an attachment pin receiving recess or hook at its lower end for holding a transverse backhoe attachment pin which is mounted to the lower backhoe support frame. The implement support assembly permits various implements such as a backhoe attachment to be mounted with a relatively quick method for mounting or removing the attachment.

Yoke assemblies, made in accordance with the teaching of the present invention, are pivotally attached at one end to the upper end of each implement support assembly. Each yoke assembly extends downwardly from the upper end of its respective implement support assembly in a spaced apart, cantilevered fashion, and its lower depending end is adjustably connected to the implement support assembly. The yoke assembly is also pinned to the upper implement support frame to provide a second attachment point between the implement support frame and implement support assembly. Tightening the adjustable connection between the yoke assembly and implement support assembly pulls the implement support frame longitudinally forward towards the implement support assembly, thereby locking the implement attachment pin in the frame bracket pin receiving recess. This locks the implement frame against the implement support assembly and eliminates any play or movement at the attachment points between the implement and prime mover.

Other advantages and meritorious features of the coupling device will be more fully understood from the following description of the preferred embodiment, the appended claims, and the drawings, a brief description of which follows.

DETAILED DESCRIPTION OF THE INVENTION

Figure 1:
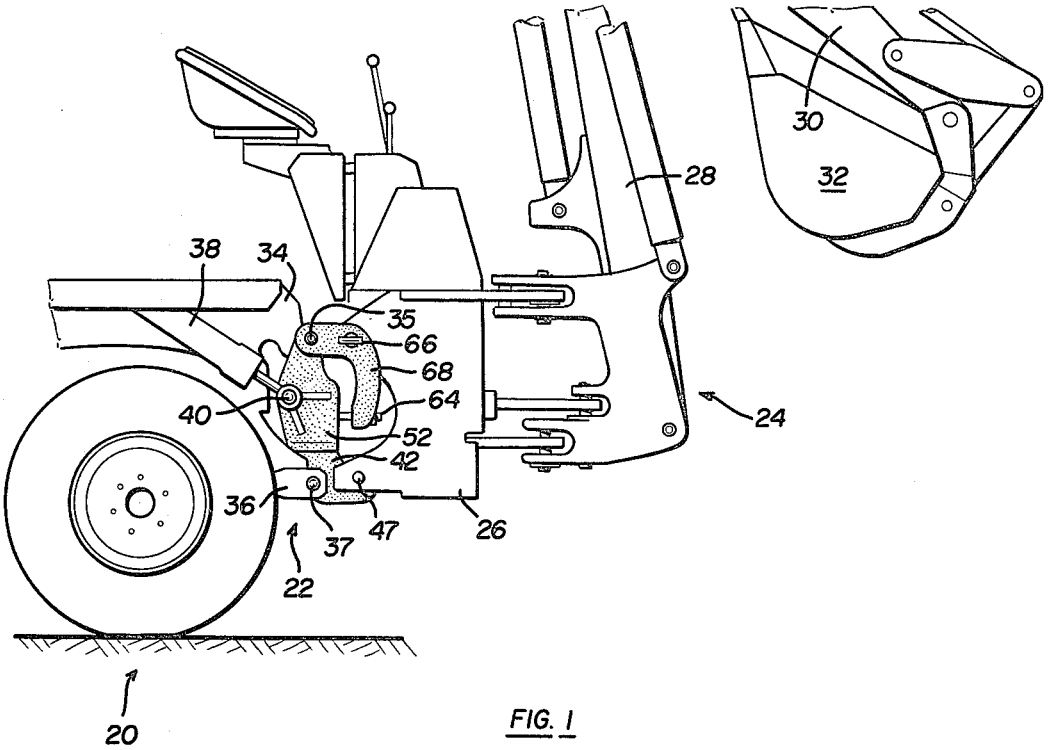
FIG. 1 is a side elevational view of the coupling device for attaching an implement such as a backhoe to a prime mover.

FIG. 1 illustrates a backhoe attachment mounted to a prime mover by the coupling device of the present invention. It will be understood that the coupling device may be used for various implements, including backhoes and the like. In the disclosed embodiment, the prime mover 20 includes the implement coupling device 22 of the present invention and a backhoe attachment 24 which is mounted to and supported from the implement coupling device. The backhoe implement illustrated is supported in an upright position, and it includes a backhoe support frame 26 carrying a rearwardly projecting boom 28 and a dipper stick 30 to which is attached a digging bucket 32.

The coupling device 22 is pivotally connected at its upper end to the prime mover 20 by a transport bracket assembly 34 and pin 35, and it is connected at its lower end to pivotal bracket 36 by pin 37. A tilt cylinder 38 extending from the prime mover is also connected to the coupling device 22 at its rod end by pin 40 for the purpose of shifting the coupling device from its illustrated upright position when desired.

Figure 2:
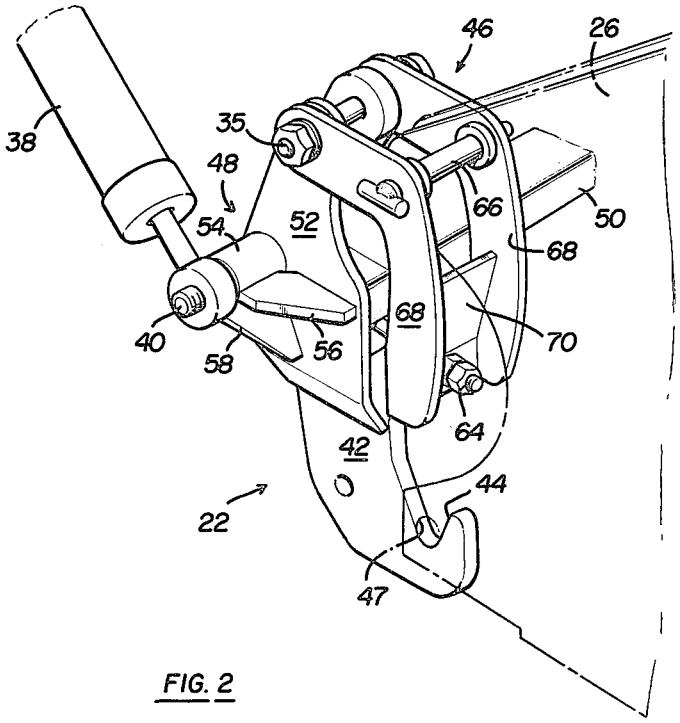
FIG. 2 is a partial perspective view of the coupling device of the present invention.
Figure 4:
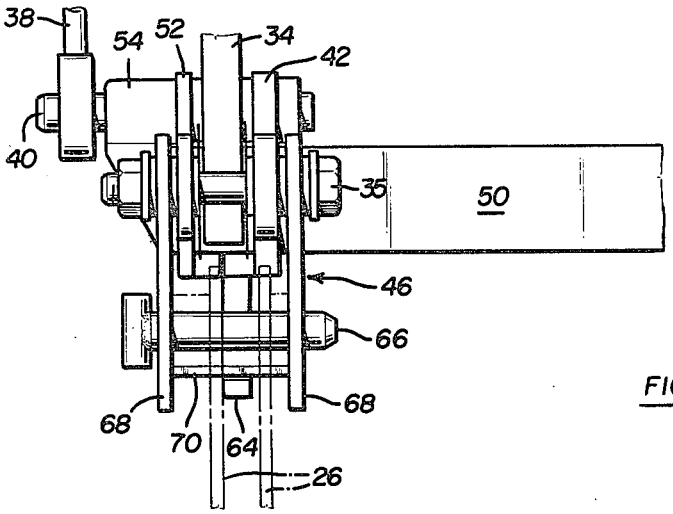
FIG. 4 is a top plan view of one of the implement support assemblies illustrated in FIG. 3.
Figure 3:
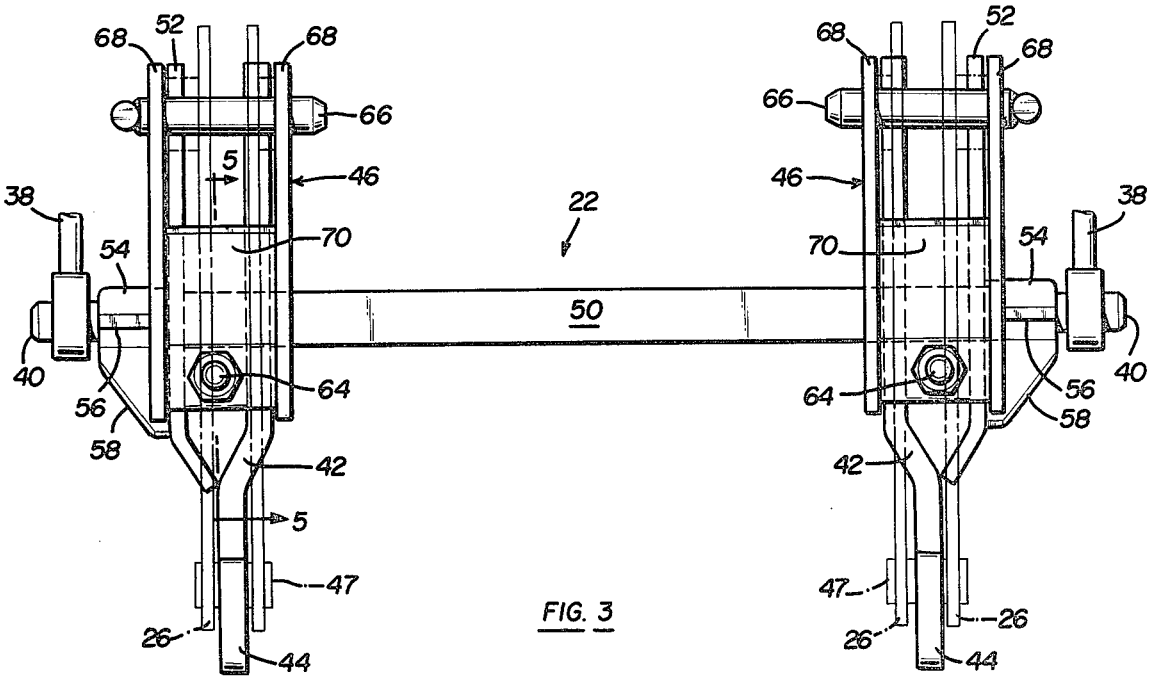
FIG. 3 is an end view of the coupling device made in accordance with the present invention illustrating the implement support assemblies connected together by a transverse crossbeam for coupling an implement support frame to a prime mover.

The coupling device 22 permits various implements such as the backhoe attachment illustrated to be mounted with a relatively quick method for mounting or removing the attachments. As illustrated in FIGS. 2 and 3, the coupling device 22 includes a pair of laterally spaced apart implement support assemblies 48 (FIG. 2), each support assembly 48 having a frame bracket or weldment 42 with an attachment pin receiving recess or hook 44 for holding a transverse attachment pin 47 that is secured to the lower backhoe support frame 26. A yoke assembly 46 is attached between the backhoe support frame 26 and each implement support assembly 48 of the coupling device for the purpose of tightly securing the backhoe attachment pin 47 against the frame bracket recess 44 thereby eliminating any tolerance movement at the attachment points between the backhoe and prime mover.

Figure 5:
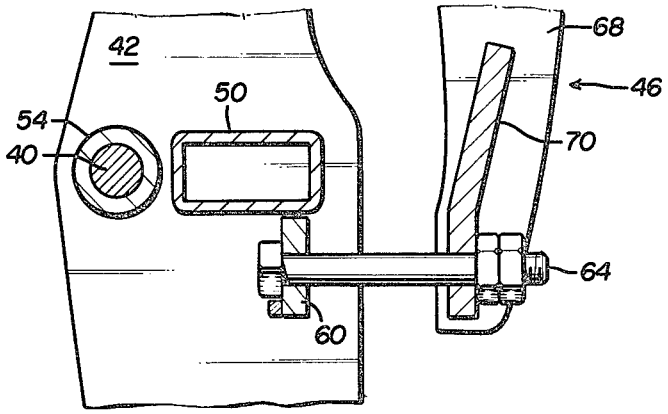
FIG. 5 is a cross-sectional view taken along line 5—5 in FIG. 3.

The pair of implement support assemblies 48 are connected together by a transverse crossbeam 50 for coupling the backhoe support frame 26 to the prime mover. As described, each implement support assembly includes a frame bracket or weldment 42 having an attachment pin receiving hook 44 at its lower end for holding a transverse backhoe attachment pin 47 which is mounted to the lower backhoe support frame 36. The implement support assembly 48 is generally Y-shaped and includes a second bracket leg 52 spaced from the first bracket leg 42. A spool cylinder 54 is mounted to bracket legs 42 and 52 for receiving pin 40 that connects tilt cylinder 38 to the implement support assembly 48. Upper and lower reinforcing gusset plates 56 and 58 extend from spool cylinder 54 and are fixedly attached to bracket leg 52 for providing additional support to the spool cylinder 44. Each implement supporting assembly 48 includes a locking plate 60 (FIG. 5) which is fixed between bracket legs 42 and 52 in the lower portion of the notch formed by the legs.

A yoke assembly 46 is pivotally attached at one end to the upper end of each implement supporting assembly 48 by pin 35. The yoke assembly 46 extends downwardly from the upper end of the implement supporting assembly 48 in a spaced apart, cantilevered fashion, and its lower depending end is adjustably connected to implement supporting assembly 48 by locking bolt 64. The yoke assembly 46 is also attached by pin 66 to the upper portion of backhoe support frame 26 to provide a second attachment point between the backhoe support frame and implement supporting assembly 48. The yoke assembly 46 includes a pair of spaced apart parallel side plates 68 which extend downwardly and are connected at their lower end by gusset plate 70.

The operation of the coupling device 22 is as follows. The backhoe support frame 26 is first mounted to the coupling assembly by capturing attachment pins 47 within implement attaching recesses 44 in weldments 42 and then connecting the upper portion of the backhoe support frame to yoke assemblies 46 by pins 66. The tightening of bolts 64 which connect yoke assemblies 46 and implement support assemblies 48 pulls the upper end of backhoe support frame 26 longitudinally forward towards the implement support assemblies 48 thereby pushing the lower end of the support frame 26 downwardly and rearwardly for locking the backhoe attachment pins 47 in the pin receiving recesses 44. This locks the backhoe frame 26 against the implement support frame assembly 48 and eliminates any play or movement at the attachment points between the frames.

It will be apparent to those skilled in the art that the foregoing disclosure is exemplary in nature rather than limiting, the invention being limited only by the appended claims.

We claim:

1. A coupling device for attaching an implement support frame to a prime mover, said coupling device comprising:

a plurality of laterally spaced apart implement support assemblies connected together by a transverse cross beam, each implement support assembly including a downwardly depending main frame bracket having an implement attaching pin receiving recess at its lower end, said recesses holding implement attachment pins which are mounted to said implement support frame;

yoke assemblies pivotally attached at one of their ends to the upper ends of said implement support assemblies and said yoke assemblies being pivotally attached to said implement support frame, each of said yoke assemblies extending downwardly from the upper end of its respective implement support assembly in a spaced apart, cantilevered fashion, each yoke assembly including adjustable locking means at its lower end, said locking means being connected between said yoke assembly and the respective implement support assembly; and said locking means on said yoke assemblies being tightened to pull the implement support frame longitudinally forward towards the implement support assemblies thereby locking said implement attachment pins within the frame bracket pin receiving recesses whereby play or movement at the attachment points between the implement support frame and prime mover is substantially eliminated.

2. The coupling device as defined in claim 1 wherein each implement support assembly is generally Y-shaped including a bracket leg spaced from said main frame bracket, a notch being formed by said bracket leg and said main frame bracket, a locking plate mounted between said bracket leg and main frame bracket in said notch for mounting one end of said adjustable locking means.

3. The coupling device as defined in claim 2 wherein each said yoke assembly includes a pair of spaced apart parallel side plates which are connected at their lower end by connecting means which supports the other end of said adjustable locking means.

4. A coupling device for attaching an implement support frame to a prime mover, said coupling device comprising:

an implement support assembly, said implement support assembly including a downwardly depending main frame bracket having an implement attachment pin receiving recess at its lower end, said recess holding an implement attachment pin which is mounted to said implement support frame;

a yoke assembly pivotally attached at one of its ends to the upper end of said implement support assembly and said yoke assembly being pivotally attached to said implement support frame, said yoke assembly extending downwardly from the upper end of said implement support assembly in a spaced apart, cantilevered fashion, said yoke assembly including adjustable locking means at its lower end, said locking means being connected between said yoke assembly and the implement support assembly; and said locking means being tightened to pull the implement support frame longitudinally forward towards the implement support assembly thereby locking said implement attachment pin within the frame bracket pin receiving recess whereby play or movement at the attachment points between the implement support frame and prime mover is substantially eliminated.

* * * * *